United States Patent [19]

Devaux et al.

[11] Patent Number: 5,072,201

[45] Date of Patent: Dec. 10, 1991

[54] SUPPORT FOR MICROWAVE TRANSMISSION LINE, NOTABLY OF THE SYMMETRICAL STRIP LINE TYPE

[75] Inventors: Francois R. Devaux, Paris; Pierre Le Coore, Sartrouville; Antoine Pereira, Seraincourt; Jean Poitevin, Villejuif, all of France

[73] Assignee: Thomson-CSF, Puteaux, France

[21] Appl. No.: 444,721

[22] Filed: Dec. 1, 1989

[30] Foreign Application Priority Data

Dec. 6, 1988 [FR] France ..... 88 15953

[51] Int. Cl.[5] ..... H01P 3/08

[52] U.S. Cl. ..... 333/238; 333/244; 333/246; 174/117 AS

[58] Field of Search ..... 333/238, 243, 244, 246; 174/28, 29, 117 AS

[56] References Cited

U.S. PATENT DOCUMENTS

| | | | |
|---|---|---|---|
| 2,351,927 | 6/1944 | Contini | 174/29 |
| 2,796,589 | 6/1957 | Adams | 333/244 |
| 3,254,315 | 5/1966 | Lattanzi | 333/123 |
| 3,514,523 | 5/1970 | Hildebrand et al. | 174/29 X |
| 3,560,896 | 2/1971 | Essinger | 333/243 |
| 3,671,662 | 6/1972 | Miller | 174/28 |
| 4,365,222 | 12/1982 | Lampert | 333/238 |
| 4,437,074 | 3/1984 | Cohen et al. | 333/244 X |

FOREIGN PATENT DOCUMENTS

| | | |
|---|---|---|
| 666243 | 9/1938 | Fed. Rep. of Germany . |
| 860512 | 12/1957 | Fed. Rep. of Germany . |
| 2927190 | 11/1980 | Fed. Rep. of Germany . |
| 907582 | 3/1946 | France . |
| 2216653 | 8/1974 | France . |
| 822274 | 10/1959 | United Kingdom . |

*Primary Examiner*—Paul Gensler
*Assistant Examiner*—Benny T. Lee
*Attorney, Agent, or Firm*—Roland Plottel

[57] ABSTRACT

The support comprises a pleated strip made of dielectric material. Each pleat has a longitudinal central slot. The internal conductive strip of the line is passed through these slots, and the ground planes are in contact with the sides of the strip. These sides bear projections that get snapped into corresponding holes of the ground planes to provide for the centering and fastening of the support.

9 Claims, 2 Drawing Sheets

SUPPORT FOR MICROWAVE TRANSMISSION LINE, NOTABLY OF THE SYMMETRICAL STRIP LINE TYPE

BACKGROUND OF THE INVENTION

1. Field of the Invention

The present invention pertains to a support for a microwave transmission line with a conductive strip, notably of the symmetrical strip line type.

2. Description of the Prior Art

Such supports are known, notably in the field of symmetrical air strip lines. These supports are designed to provide for the mechanical support of the internal conductor of the line and are arranged as spacers between the ground planes or between a ground plane and the internal conductor.

Such supports are described, for example, in the French patent No. 1 573 432 or in the French patent application No. 88 03682 filed on 22nd Mar. 1988. However, these supports have great volume and mass, and this becomes a major drawback when the line works in a field for these supports disturb the field. Furthermore, their positioning all along the line causes localized faults which recur with the pitch chosen for the supports. Finally, the quantity of dielectric used causes a certain degree of loss which cannot be reduced.

SUMMARY OF THE INVENTION

An aim of the present invention is to overcome these drawbacks.

An object of the present invention is a support for microwave lines with reduced mass and volume, integrated with the impedance of the line and having excellent resistance to vibrations and minimized disturbance of propagation in the transmission line.

According to the invention, there is provided a support for microwave transmission lines with conductive strips, notably of the symmetrical strip line type, comprising a pleated strip of dielectric material, each fold of this pleated support having a longitudinal slot so that the the strip of said line can be inserted into said pleated support, the width of the slot being matched with the thickness of said strip of the line; and projections extending beyond at least one side of the strip to provide for the positioning of the strip made of dielectric material and of the line that it supports with respect to at least one ground plane on which it rests by said side, said projections getting housed in corresponding holes of said ground plane.

BRIEF DESCRIPTION OF THE DRAWINGS

The invention will be better understood and other characteristics and advantages will appear from the following description and the appended figures, wherein.

The same elements are designated by the same elements in all the figures.

DESCRIPTION OF THE PREFERRED EMBODIMENTS

Figure 1:
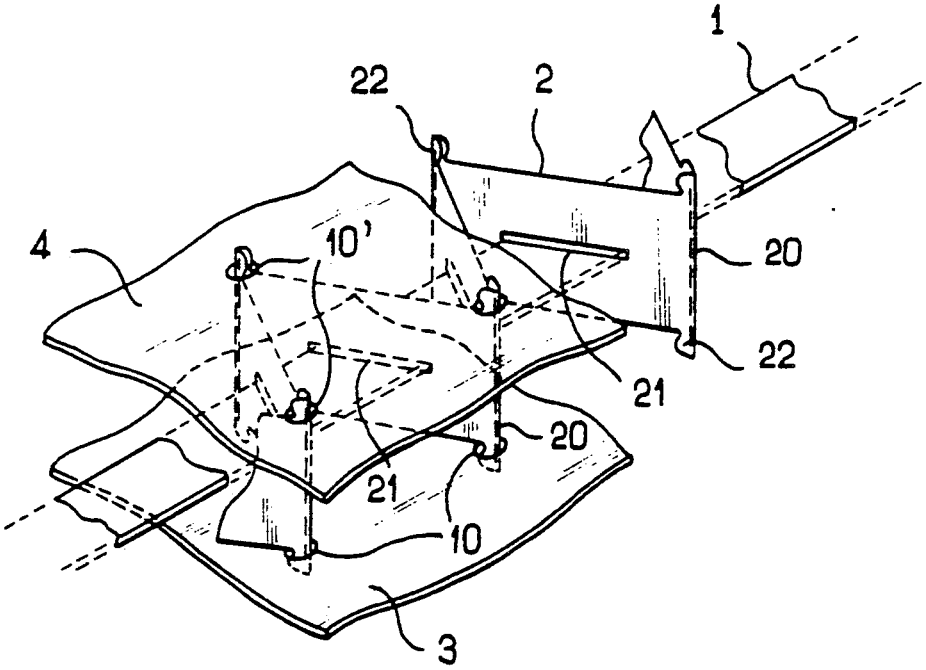
FIG. 1 gives a partial view, in perspective, of the support according to the invention with the conductive strip that it holds.

FIG. 1 gives a partial view, in perspective, of a conductive strip 1 of a microwave transmission line which is held mechanically by a support formed essentially by a strip 2 made of a dielectric material such as the one known under the trademark Mylar. This strip 2 is pleated and has longitudinal slots 21 placed at the center of the folds of the strip. These slots have a width corresponding to the thickness of the conductive strip 1 of the line to be supported and a length enabling the folds to be placed so as to be in a given angle with respect to a transversal plane perpendicular to the axis of the strip 1. It shall be assumed herein that we are considering the case of a transmission line of the symmetrical air strip line type comprising an internal conductive strip 1 kept at equal distance between two parallel ground planes 3 and 4, without the invention's being thereby restricted in any way.

Perforations 20 are punched in at each fold line, enabling the strip 2 to be folded after machining without any tools being needed. The folding may be done, for example, by hand. When the folds are pressed against one another, it is very easy to pass the conductive strip 1 through the slots 21. When the folds are relaxed the support, due to the elasticity of the material, takes the shape shown in FIG. 1, with the folds at a distance from one another. The strip 2 made of dielectric material has projections 22 on either side, cut out of the same material and at the same time as the rest of the strip 2. These projections 22 are preferably placed at the fold lines and they are designed to get engaged in corresponding holes 10, 10' of the ground planes 3, 4 (shown partially) to provide for the positioning of the unit. The width of the strip 2 is chosen so that, when the projections are engaged in the corresponding holes of the ground planes, the sides of the strip 2 are substantially in contact with the ground planes. This provides for a highly efficient and precise mechanical holding of the transmission line, with excellent resistance to vibrations. Naturally, the projections 22 can be provided on only one side of the conductive strip 1, namely at one in every two fold lines. It is also possible to consider placing these projections at other points of the sides of the strip than at the fold lines. Furthermore, it is also possible to give these projections 22 shapes such that they can get engaged by being snapped into the holes of the ground planes, with the support then contributing to the mechanical holding of the ground planes.

The support to be used for the symmetrical strip lines should meet the following criteria:

it should provide for a proper centering of the line;

it should provide for holding under vibrations;

it should permit the thermal expansions of the line, particularly if the internal conductive strips and the ground planes are not formed by one and the same conductive material;

it should use as little dielectric as possible to minimize the losses.

It is clear that the support according to the invention fulfils all these criteria. But it provides numerous additional advantages:

it is integrated with the line;

the projections 22 provide for the centering and may further enable the support to be fixed by being snapped into the ground plane;

the support is ventilated, and enables proper cooling of the line.

Figure 2:
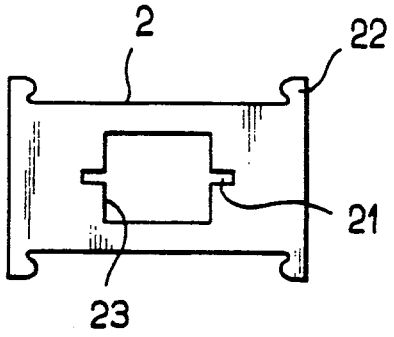
FIG. 2 is a view of a first variant of a fold of the support according to the invention.
Figure 3:
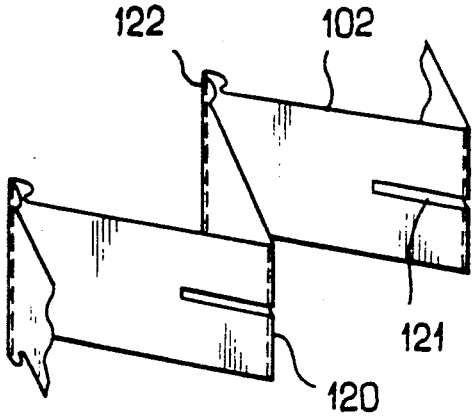
FIG. 3 is a view in perspective of a second variant of a support according to the invention.

If it is sought to further improve this cooling and, at the same time, lighten the support and reduce losses, it is possible to use the alternative embodiment of FIG. 2 which represents a supporting fold 2 seen from the front. It is seen that the central part of the slot 21 is widened by a clearance 23 which reduces the quantity of dielectric material and permits the flow of air FIG. 3 represents another variant of a support according to the invention wherein the slots 121 are shifted so as to be astride one in every two fold lines of the strip 102. Thus, the conductive strip to be supported no longer has to passed through the support but may be inserted therein from the outside, laterally. Besides, this support still has the folding perforations 120 and centering and fixing projections 122 which exist herein only on the side opposite the slots.

Figure 4:
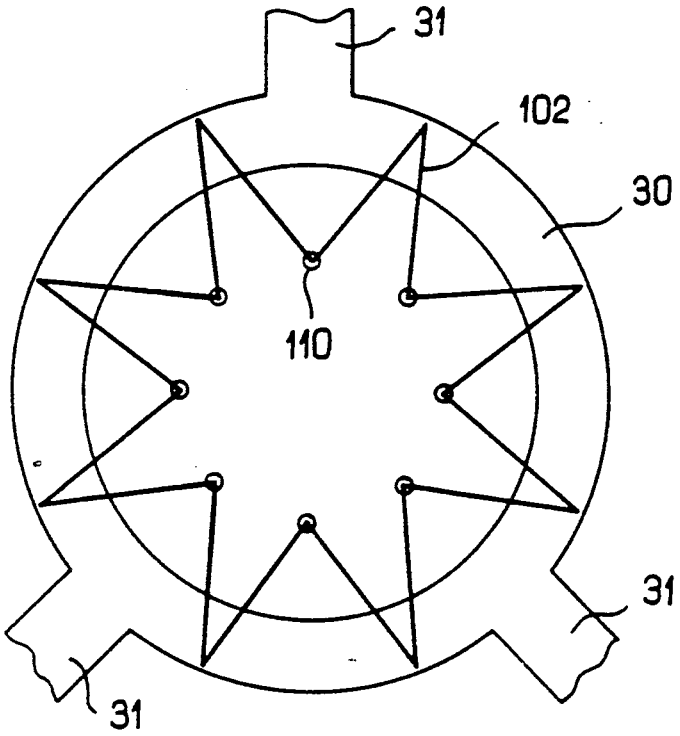
FIG. 4 shows a top view of a closed line maintained by the support of FIG. 3.

A support such as this is particularly useful for the maintaining of closed lines, as can be seen in FIG. 4. This figure shows an internal ring-shaped conductive strip 30 having access points 31. The support 102 is set within the ring, the centering holes 110 being made only at the center of the ring, in correspondence with the projections 122.

The supports according to the invention can be made to stringent tolerance values by machining the Mylar strip, for example by laser providing for the cutting of the strip with its projections and slots and perforations.

The exemplary embodiments described clearly do not restrict the scope of the invention.

What is claimed is:

1. A support for microwave transmission lines of the symmetrical strip line type comprising a central conductive strip of a given thickness disposed between two parallel ground planes spaced from one another by a predetermined distance, said support comprising:

a strip of dielectric material having a transversal direction and two longitudinal sides spaced by said predetermined distance and having a median line parallel to said longitudinal sides, said strip of dielectric material being pleated into a plurality of folds along fold lines parallel to said transversal direction, each fold having a longitudinal slot aligned parallel to said sides and having a greater width than said thickness of said conductive strip so that said central conductive strip is passed through the slot of said pleated support; and projections extending beyond at least one longitudinal side of said strip of dielectric material to provide for the positioning of said strip of dielectric material between said ground planes with said transverse direction perpendicular to said planes, said ground plane in contact with said at least one longitudinal side having holes in which said projections get housed.

2. A support according to claim 1, wherein said projections have a shape such that they enable the fixing of said strip made of dielectric material by snapping into the corresponding holes of the ground planes.

3. A support according to claim 1, wherein said slots are positioned centrally in each fold with said central conductive strip positioned in the slots of said support.

4. A support according to claim 3, wherein each slot has a widened central part with respect to the width of said slot.

5. A support according to claim 1, wherein said longitudinal slots are positioned to be straddling every other fold line of said strip of dielectric material, said slots following said median line of said strip of dielectric material, said central conductive strip being thus inserted into said slots.

6. A support according to claim 5, wherein said projections are placed at each fold line that has no slots.

7. A support according to claim 1, wherein said strip of dielectric material has perforations formed along each fold line.

8. A support according to claim 1, wherein said projections are placed at each fold line of the strip of dielectric material.

9. A support according to any one of the claims 1 to 7, wherein said strip of dielectric material is made of Mylar.

* * * * *